US006544473B1

(12) United States Patent
Shintaku et al.

(10) Patent No.: US 6,544,473 B1
(45) Date of Patent: Apr. 8, 2003

(54) METHOD AND APPARATUS FOR PERFORMING STERILIZING TREATMENT ON PLASTIC CONTAINER

(75) Inventors: Kenichi Shintaku, Kanazawa; Eizou Amano, Otsuki, both of (JP)

(73) Assignee: Shintaku Kogyo Co., Ltd, Isikawa-ken (JP)

( * ) Notice: Subject to any disclaimer, the term of this patent is extended or adjusted under 35 U.S.C. 154(b) by 151 days.

(21) Appl. No.: 09/635,149

(22) Filed: Aug. 8, 2000

(Under 37 CFR 1.47)

Related U.S. Application Data

(63) Continuation of application No. PCT/JP99/00723, filed on Feb. 18, 1999.

(30) Foreign Application Priority Data

Feb. 19, 1998 (JP) ..... 10-037613
Feb. 19, 1998 (JP) ..... 10-037614

(51) Int. Cl.[7] ..... A61L 2/08

(52) U.S. Cl. ..... 422/26; 422/1; 422/292; 422/302; 422/303; 422/297; 422/300

(58) Field of Search ..... 422/1, 26, 292, 422/302, 303, 297, 300

(56) References Cited

U.S. PATENT DOCUMENTS 3,531,299 A * 9/1970 Benjamins ..... 422/303
3,661,505 A * 5/1972 Frolich ..... 422/303
4,088,444 A * 5/1978 Byrne ..... 422/303
4,349,508 A * 9/1982 Liede ..... 422/1
4,511,538 A * 4/1985 Buchner et al. ..... 422/303
4,635,662 A * 1/1987 Totten ..... 134/68
5,464,595 A * 11/1995 Finnah ..... 422/297
5,598,859 A * 2/1997 Kronseder ..... 134/62

FOREIGN PATENT DOCUMENTS

| | | |
|---|---|---|
| JP | 57-55147 | 4/1982 |
| JP | 62-296866 | 12/1987 |
| JP | 2-97022 | 4/1990 |
| JP | 2-258529 | 10/1990 |
| JP | 3-280955 | 12/1991 |
| JP | 4-189727 | 7/1992 |
| JP | 9-272515 | 10/1997 |

* cited by examiner

*Primary Examiner*—Krisanne Thornton
(74) *Attorney, Agent, or Firm*—Nixon & Vanderhye PC

(57) ABSTRACT

The present invention is a method and an apparatus for performing heating and sterilizing treatment on the inside of a PET bottle with a low heat resistance securely and without thermal deformation thereof, where a steam jetting nozzle is inserted into the bottle from a mouth portion thereof to jet steam from the nozzle, the steam is circulated inside the bottle to be exhausted from the mouth portion, the steam is caused to contact with a bottle inner face securely, and simultaneously cooling water is sprayed on an outer face of the bottle so that thermal deformation of the bottle wall face is prevented.

17 Claims, 13 Drawing Sheets

METHOD AND APPARATUS FOR PERFORMING STERILIZING TREATMENT ON PLASTIC CONTAINER

CROSS-REFERENCE TO RELATED APPLICATIONS

This is a continuation of PCT application PCT/JP99/00723, filed Feb. 18, 1999, the entire content of which is hereby incorporated by reference in this application.

This application is based upon and claims the benefit of priority from the prior Japanese Patent Applications No. 10-037613, filed Feb. 19, 1998; and No. 10-037614, filed Feb. 19, 1998, the entire contents of which are incorporated herein by reference.

BACKGROUND OF THE INVENTION

The present invention relates to a method for performing sterilizing treatment on such a plastic container as a PET bottle and the like. In particular, the present invention relates to a method and an apparatus for performing heating and sterilizing treatment on an inner face of a plastic container having a low heat-resistance securely without thermally deforming the same.

Conventionally, the so-called PET bottle is widely used as a plastic container filled with a drink or the like. In this case, before a drink is filled in such a PET bottle, sterilizing treatment must be performed on an inner face of the bottle. Incidentally, as the sterilizing treatment for a drink container, there are various treatments such as sterilization which dies out bacteria completely in a strict sense, sterilization which reduces or incapacitates bacteria down to a required level, and the like. In this specification, treatments including all of these treatments are referred to as sterilizing treatments.

As such a sterilizing treatment, there is one where heating and sterilizing treatment is performed by jetting hot water on to an inner face of a PET bottle. Such a heating and sterilizing treatment is generally applied alone or in combination with another sterilizing treatment such as jetting of ozone water or the like. In such a heating and sterilizing treatment, there are advantages such as simple steps, secure treatment and the like, but there are the following problems to be solved.

The first problem is that heat resistance is required for a container to be subjected to sterilizing treatment. In order to obtain effect of sterilizing treatment, it is necessary to jet hot water having a temperature of 65 to 70° C. or more. However, such a high temperature exceeds a heat resistance temperature of resin material for a container and deformation occurs in the container due to heat. Accordingly, for example, in a case that heating and sterilizing treatment is performed by jetting hot water on an inner face of a PET bottle, it is necessary to use a PET bottle using heat resistance material. For this reason, cost for a container is increased and kind of containers which can be subjected to sterilizing treatment is limited.

Also, the second problem is related to a temperature range of hot water and safety. When the temperature of this jetting hot water becomes higher, the effect of the sterilizing treatment becomes higher, so that it is preferable that the temperature of the hot water is higher. However, since there are portions where pressure of hot water is lowered locally inside pipes or valve apparatuses for supplying the hot water, when the temperature of the hot water becomes about 90° C. or more, there is a possibility that boiling occurs at low pressure generating portions in the pipes or the valve apparatuses, so that the temperature of the hot water must be maintained at about 90° C. or less. Also, though it is considered that the hot water is pressurized and supplied thereby preventing boiling in pipes such as the above, hot water having a high pressure and a high temperature is not preferable in view of safety because there is a high risk that, if the pipe or the like is broken, hot water is scattered far and it attaches to a human body to burn him/her.

Also, the third problem is related to energy cost for producing the above hot water. In this manner, since the hot water which has been jetted on the inner face of the container is disposed as it is, energy cost for producing a large amount of hot water becomes high.

Furthermore, the fourth problem is a problem where hot water is jetted uniformly on the inner surface of the container. When a container to be subjected to sterilizing treatment has a complicated shape, it becomes difficult to jet hot water uniformly and thoroughly on the inner surface thereof. Also, even when the entire shape of a container is simple, for example, in the case of a PET bottle, there are many bottles where a number of ribs or recess/projection portions are formed on wall faces in order to increase rigidity of a bottle, improve design matter, and the like. There is a possibility that portions where jetting of hot water or falling-down thereof is obstructed are formed on these ribs or recess/projection portions, so that reliability of sterilizing treatment may be injured in some cases. Also, recently, a PET bottle which is crushed to decrease its volume at a time of disposal has been required. In such a bottle, it is anticipated that wall faces of the bottle are constituted in a complicated manner in order to facilitate crushing. In such a case, there is a possibility that portions of the bottle on which hot water is not jetted sufficiently occur.

In order to solve the above first problem, there has been recently proposed a method where hot water is jetted on an inner face of a PET bottle and simultaneously cooling water is jetted on an outer face of the bottle to cool the bottle wall face so that the bottle is prevented from deforming due to heat. According to such a method, since the temperature of the bottle wall face is prevented from increasing, such an effect can be obtained that it is made possible to perform heating and sterilizing treatment of hot water jetting even on an anti-heat resistant bottle.

However, it is necessary to suppress the temperature of the jetting hot water to 90° C. or less in order to prevent boiling or the like in pipes in the above manner, and there is a limitation in the temperature of the hot water. Also, the heat transfer from the hot water to the bottle wall face is a heat transfer due to impingement of jet flow of fluid to wall face, so-called impinge heat transfer, and it is a heat transfer system having a highest efficiency as a heat transfer system between fluid and wall face. Accordingly, since a large amount of heat is transferred from hot water to bottle wall face, the effect of the prevention of temperature rising on the wall face becomes insufficient even if the outer face of the bottle is being cooled. For this reason, for example, in a case of an anti-heat resistant PET bottle, the temperature of the hot water must be set to a temperature lower that the above 90° C. in order to prevent thermal deformation of the bottle. Accordingly, the efficiency or reliability of the heating and sterilizing treatment is lowered.

Also, in the above method, there is an effect that deformation of a container due to heat can be prevented in the above manner, but the above-mentioned second and fourth problems can not be solved essentially.

In order to solve the problems as mentioned above, a method is considered that an outer face of a bottle is cooled with cooling water or the like and steam is jetted on to an inner face of the bottle so that heating and sterilizing treatment is performed. Steam has a heat capacity smaller than that of hot water, so that only an inner face portion of a wall face of a bottle is heated to a high temperature but the heat amount transferred to the wall face is small. For this reason, the temperature of an outside of the wall face of the bottle is suppressed to a low temperature so that heat deformation of the bottle can be prevented effectively. Also, since there occurs no boiling in pipes or the like, the temperature of steam can be made higher than that of hot water and heating and sterilizing treatment can be performed more effectively. Also, since steam has a high fluid property and it is not affected by gravity, even when the shape of a bottle is complicated, steam contacts with an inner face of the bottle uniformly so that it is made possible to perform heating and sterilizing treatment securely.

By the way, the steam which has been jetted inside a bottle is circulated inside the bottle and exhausted from a mouth portion. Since the heat capacity of the steam is small, as mentioned above, the temperature of the steam is lowered during the circulation inside the bottle, and the steam whose temperature has been lowered in this manner is exhausted through the mouth portion, so that the temperature of the mouth portion is not increased sufficiently in some cases. Such a drawback is easy to occur when the content volume of a PET bottle is large.

BRIEF SUMMARY OF THE INVENTION

The present invention has been achieved in view of the above circumstances, and it is to provide a method for performing sterilizing treatment on a plastic container which has a high safety and can reduce cost, which can perform heating and sterilizing treatment on an inner face of a plastic container having a relatively low heat resistance effectively and securely, and which can prevent the container from deforming due to heat effectively.

Also, the present invention is to provide an apparatus for performing sterilizing treatment on a plastic container, which can perform heating and sterilizing treatment on a plastic container on an inner face of a plastic container having a relatively low heat resistance effectively and securely and which can heat the inner face of the container up to a predetermined temperature more uniformly.

In order to solve the above problems, the method of the present invention is a method for performing sterilizing treatment on a container made of plastic material comprising the steps of: inserting a steam jetting nozzle into a mouth portion of a container to be subjected to sterilizing treatment with a clearance formed between the nozzle and an inner face of the mouth portion; jetting steam into the container from the steam jetting nozzle and circulating the jetted steam in the container to exhaust the steam from the clearance between the steam jetting nozzle and the inner face of the mouth portion; and supplying cooling medium to an outer face of the container simultaneously with the step of jetting steam to cooling a wall face of the container.

Accordingly, the inner face of the wall face of the container is heated and sterilized with steam jetted and the outer face of the wall face is cooled with cooling medium, and the heat capacity of steam is smaller than that of hot water and a heat amount which is transferred to a wall face of the container is small, so that the temperature rising of the wall face of the container is suppressed to be low. Therefore, even in a case of a container having a low heat resistance, steam with a high temperature is jetted so that heating and sterilizing treatment can be performed securely.

Also, an embodiment of the method of the present invention is characterized in that the temperature of steam jetted from the steam jetting nozzle is 95° C. or more. Accordingly, heating and sterilizing treatment can be performed more securely and more effectively, and the amount of heat transfer from the steam to the container wall face is small, so that the temperature of the container wall face is suppressed to be low and heat deformation or the like is prevented from occurring.

Also, in an embodiment of the method of the present invention, the step of inserting the steam jetting nozzle into the mouth portion of the container is to insert the steam jetting nozzle from the underside of the container into the mouth portion of container which is put in an inverted state where the mouth portion is directed downward, and the step of jetting steam is to jet steam into container upward towards the bottom thereof to circulate the steam along the inner face of the wall face of the container and exhaust the circulated steam from the mouth portion of the container. Accordingly, water which has been condensed on the container inner wall is caused to flow down due to gravity so that the water can be exhausted together with steam from the mouth portion effectively and the effect of sterilizing treatment is high. Also, in a case that, after the sterilizing treatment, another sterilizing treatment is performed, the condensed water is prevented from obstructing the another sterilizing treatment.

Also, an embodiment of the method of the present invention is characterized by further comprising the step of directly jetting steam on the inner face of the mouth portion of the container. Since steam which has been circulated in the container passes through the inner face of the mouth portion, the steam with a reduced temperature contacts with the inner face so that the effect of the heating and sterilizing treatment tends to lower. However, by jetting stream directly to the mouth portion, heating and sterilizing treatment can be performed on the inner face of the mouth portion more securely.

Also, an embodiment of the method of the present invention is characterized by further comprising the step of jetting steam on an outer face of the mouth portion of the container. Accordingly, simultaneously with the heating and sterilizing treatment on the inner face of the mouth, the outer face of the mouth is also subjected to heating and sterilizing treatment, so that a possibility that the inside of the container is contaminated secondarily after the heating and sterilizing treatment can be prevented securely.

Also,an embodiment of the method of the present invention is characterized in that the cooling medium supplied to the outer face of the container is cooling water. Accordingly, the outer face of the container can be cooled easily and securely.

Also, an embodiment of the method of the present invention is characterized in that the cooling medium supplied to the outer face of the container is cooling wind. Accordingly, the outer face of the container can be cooled by an equipment having a simple structure, and there is no possibility that such a problem as contamination in the container or the like occurs due to cooling water, so that more secure sterilizing treatment can be performed.

Also, an embodiment of the present invention is characterized in that steam jetted form the steam jetting nozzle into the container is pure water steam where impurities are removed from steam supplied from a boiler. Accordingly, there is no possibility that the inside of the container is contaminated secondarily by the steam and secure sterilizing treatment can be performed.

Also, an embodiment of the method of the present invention is characterized in that steam jetted from the steam jetting nozzle into the container is pure water steam where impurities are removed from steam supplied from a boiler. Accordingly, there is no possibility that the inside of the container is contaminated secondarily by the steam and secure sterilizing treatment can be performed.

Also, in order to achieve the above object, an apparatus of the present invention is characterized by comprising a holding mechanism for holding a container to be subjected to sterilizing treatment, a steam jetting nozzle inserted into a mouth portion of the container, and a steam supplying mechanism for supplying steam to the steam jetting nozzle to jet the steam from the nozzle into the container, in which the diameter of the steam jetting nozzle is smaller than the inner diameter of the mouth portion of the container, a clearance is formed between an inner peripheral face of the mouth portion and an outer peripheral face of the steam jetting nozzle, and a side nozzle hole which is opposed to the inner peripheral face of the mouth portion of the container for jetting steam to the inner peripheral face of the mouth portion is formed in the steam jetting nozzle so as to open on an outer peripheral face thereof.

Accordingly, since the outer face of the container is cooled by cooling medium, the container is prevented from heat-deforming, and only the inner face thereof is heated up to a high temperature by steam so that heating and sterilizing treatment can be performed effectively and efficiently. Also, since the heat capacity of steam is small, the amount of heat transferred from the steam to a wall face of the container becomes small, the temperature rising of the wall face is small, and the heat deformation of the container is prevented more effectively. Also, since the fluid property of steam is large and steam is not affected by gravity, the inner face of the container can be caused to contact with steam uniformly and everywhere, even when the shape of the container is complicated. Also, since boiling does not occur in pipes or the like, there is no limitation in the temperature of the steam and a safety is high even when breaking of a pipe or the like occurs.

Also, the steam jetted into the container is exhausted from the clearance between the mouth portion and the nozzle after circulated in the container. In this case, there is a case that the temperature of the steam passing through the mouth portion is lowered so that the temperature rising of an inner face of the mouth portion becomes insufficient, but since steam is jetted directly on to the inner peripheral face of the mouth portion from the side nozzle hole on the outer periphery of the steam jetting nozzle, the mouth portion can sufficiently be heated.

Also, in an embodiment of the apparatus of the present invention, the holding mechanism is provided with a grasping mechanism for grasping the mouth portion of the container, and the grasping mechanism is structured so as to invert the container while grasping the mouth portion of the container to maintain the container in a state where the container is inverted such that the mouth portion of the container is directed downwardly.

Accordingly, hot water condensed on the inner face of the container flows down due to gravity and it is exhausted from the mouth portion together with steam so that the condensed water does not remain in the container.

Also, an embodiment of the apparatus of the present invention is characterized by comprising a mouth portion outer face nozzle for jetting steam towards an outer face of the mouth portion of the container. Accordingly, since heating and sterilizing treatment is also performed on the outer face of the mouth portion, a possibility that secondary contamination occurs inside the container is prevented.

Also, in an embodiment of the apparatus of the present invention, an opening/closing valve for shutting off steam supplied to the steam jetting nozzle is provided in the steam supplying mechanism, and a bypass valve for supplying a predetermined amount of steam to the steam jetting mechanism even when the opening/closing valve is in a closed state is provided so as to bypass the opening/closing valve in parallel therewith. Accordingly, even when the opening/closing valve is closed to stop jetting of steam, steam is supplied to the nozzle through the bypass valve little by little so that contamination in the nozzle is prevented.

Also, an embodiment of the apparatus of the present invention is characterized in that an opening/closing valve for shutting off steam supplied to the steam jetting nozzle is provided in the steam supplying mechanism and a bypass passage for supplying steam to the steam jetting nozzle even when the opening/closing valve is in a closed state is formed inside the opening/closing valve. Accordingly, like the above embodiment, even when the opening/closing valve is closed to stop jetting of steam, steam is supplied to the nozzle through the bypass valve little by little so that contamination in the nozzle is prevented.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will be explained below with reference to the drawings. A first embodiment of the present invention relates to a method for performing heating and sterilizing treatment on a plastic container, for example, a PET bottle, and it is explained together with a sterilizing treatment apparatus for carrying out this method with reference to FIG. 1 to FIG. 12.

Figure 1:
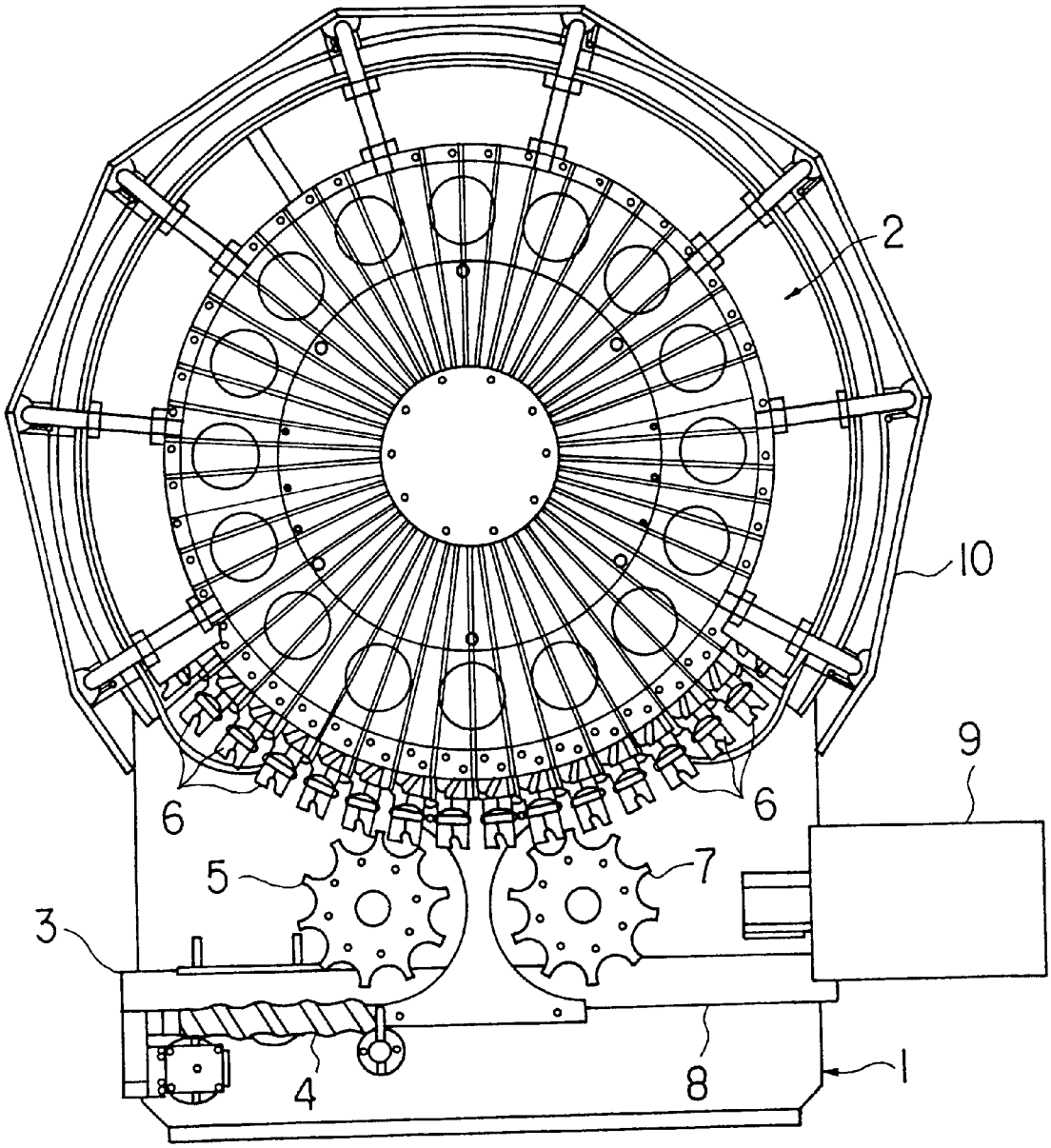
FIG. 1 is a plan view of an apparatus used for a method of a first embodiment of the present invention.
Figure 2:
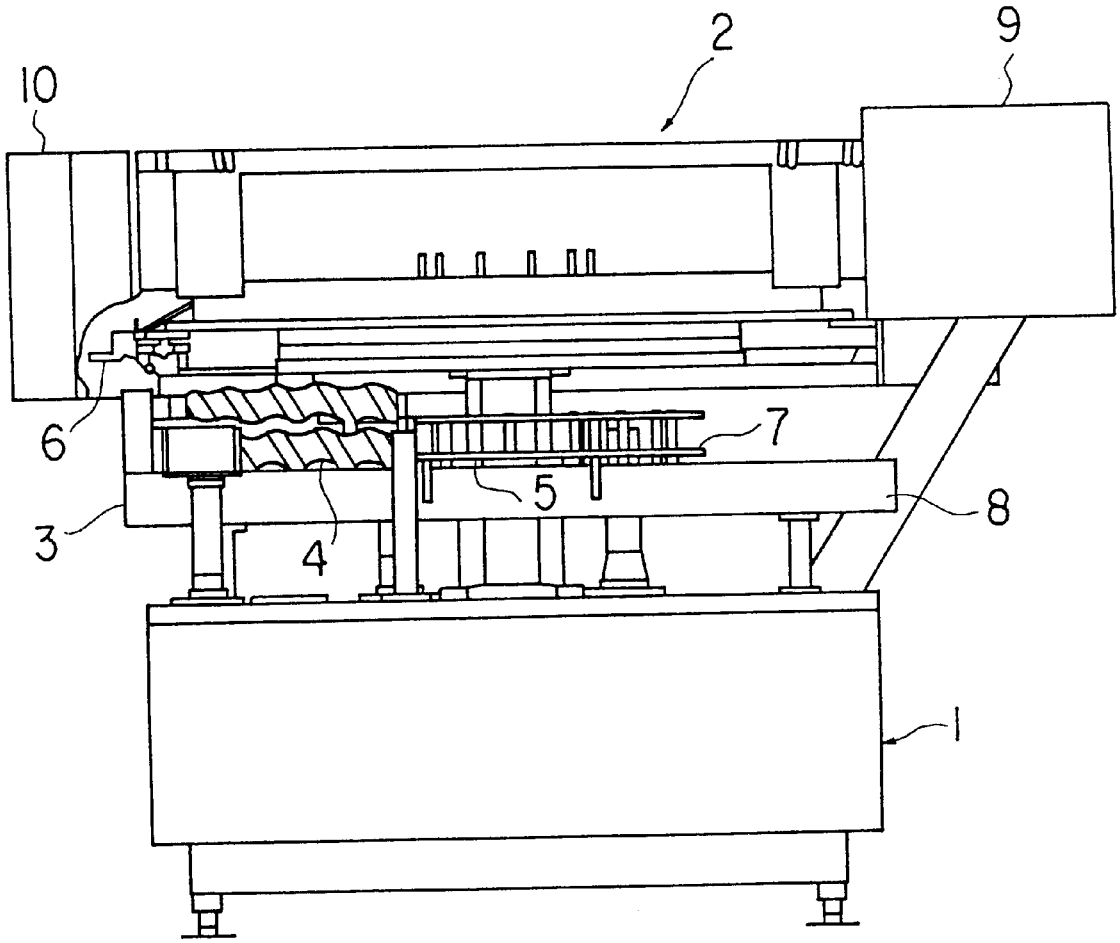
FIG. 2 is a front view of the apparatus shown in FIG. 1.

A schematic structure of this apparatus will be explained with reference to FIG. 1 and FIG. 2. FIG. 1 is a plan view of the entire of the apparatus and FIG. 2 is a front view thereof. In the figures, reference numeral 1 denotes a main body of the apparatus. The main body 1 is arranged horizontally on a floor face or the like. Then, a rotating table 2 is rotatably provided on an upper face of the main body 1 within the horizontal face. The rotating table 2 is rotated and driven by a driving mechanism or the like provided in the main body 1 in a clockwise direction in FIG. 1.

Also, a feeding-in conveyor 3 is provided at a front end portion of the above main body 1. A screw conveyor mechanism 4 is provided at a side portion of the feeding-in conveyor 3, so that plastic containers, for example, PET bottles, are conveyed in a right erected state thereof. Also, a feeding-in rotor 5 is provided at a trailing end portion of the feeding-in conveyor 3 so that bottles which have been conveyed are transferred to the rotating table 2 one by one.

Many grasping mechanisms 6 are provided at a peripheral portion of the rotating table 2, and mouth portions of the bottles which have been conveyed are grasped by the grasping mechanisms and the bottles are rotated 180° up and down and they are put in an inverted state such that the mouth portions are directed downward. Then, a series of sterilizing treatments of the embodiment of the present invention such as cleaning with ozone water, heating and sterilizing treatment with steam jetting, finishing cleaning, outside cleaning, and the like are performed on the insides of the bottles during one rotation of the rotating table 2.

The bottle which has been subjected to the above sterilizing treatment by one rotation of the rotating table 2 is returned back to a right erected state again, it is transferred to a feeding-out conveyor 8 by the feeding-out rotor 7 and it is sent to the next filling step of a drink or the like. Incidentally, reference numeral 9 denotes a control device for controlling operation of the apparatus and 10 denotes a cover of the rotating table 2.

Next, structures and operations of respective portions of such a sterilizing treatment apparatus will be explained. In FIG. 3 to FIG. 7, the structures of the grasping mechanism 6 for grasping a PET bottle 20, a heating and sterilizing mechanism 40 for performing steam heating and sterilizing treatment on the inside of the bottle 20, a cooling mechanism 60 for cooling an outer face of the bottle 20, and the like are shown.

First, the above grasping mechanism 6 is provided with a chuck mechanism 30, and the chuck mechanism 30 is attached rotatably about a shaft 31 extending horizontally relative to the rotating table 2. This chuck mechanism 30 is provided with a pair of chuck arms 32, 33, and one chuck arm 33 is rotated about a shaft 36 so that these chuck arms 32, 33 are opened and closed.

Chuck blocks 34, 35 made of synthetic resin material or the like are respectively provided at distal end portions of the chuck arms 32, 33, and they are structures so as to grasp a flange portion 22 formed at the mouth portion 21 of the bottle 20. Incidentally, a cut-out portion 37 is formed on one chuck block 34 in order to prevent interference with the mouth portion 21 when the bottle 20 is conveyed in and conveyed out.

Figure 3:
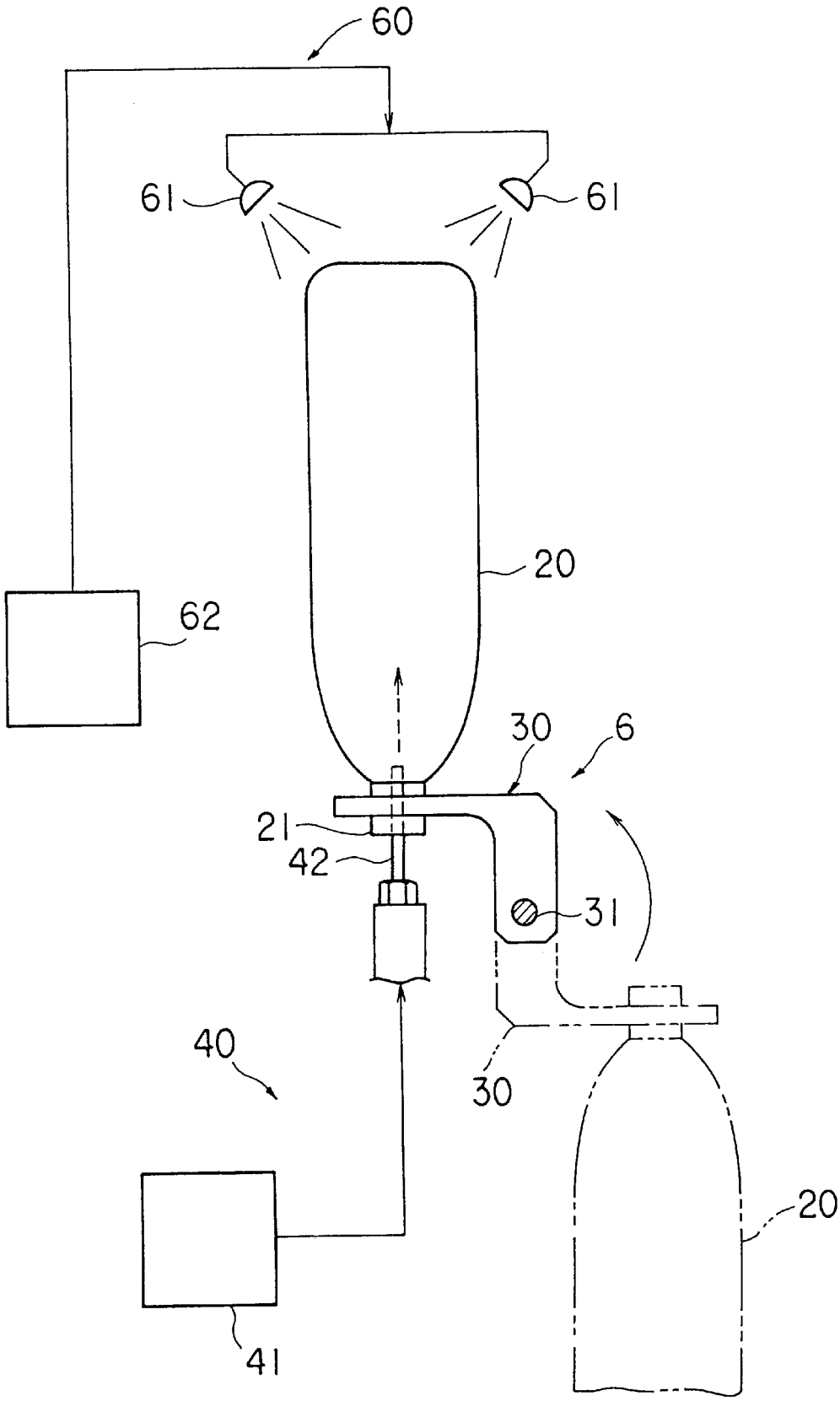
FIG. 3 is a schematic side view of a grasping mechanism portion of the apparatus shown in FIG. 1.
Figure 4:
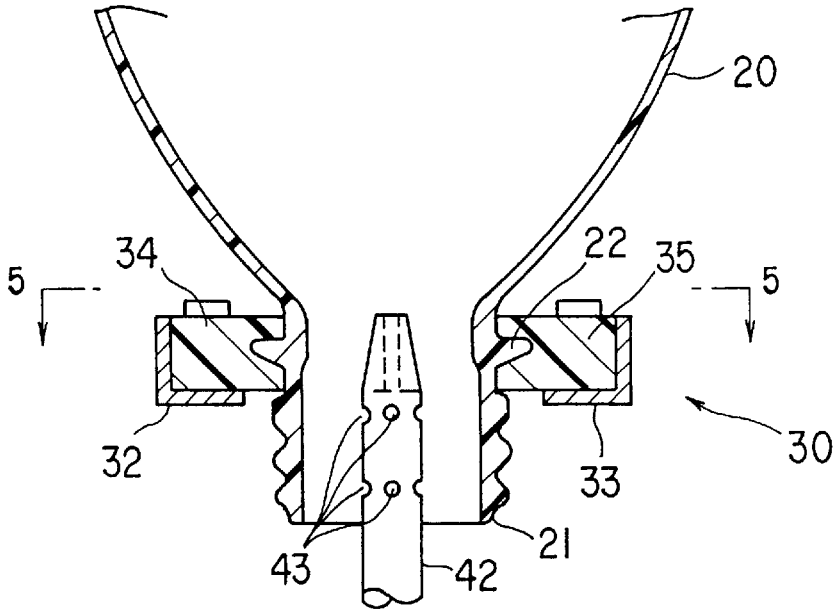
FIG. 4 is a longitudinal sectional view of a mouth portion outer face nozzle portion of a mouth portion of a bottle.
Figure 5:
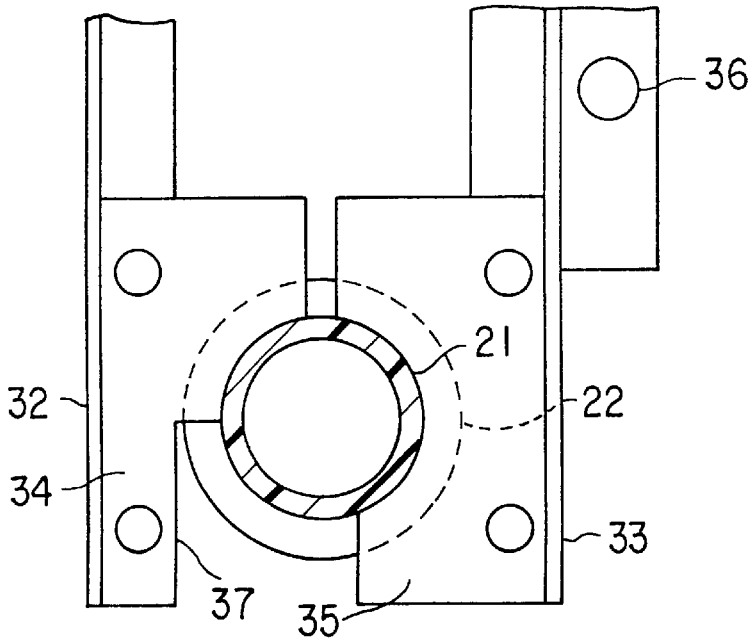
FIG. 5 is a view seen along an arrow 5—5 in FIG. 4.

Then, after grasping the mouth portion 21 of the bottle 20 which has been conveyed in, the above chuck mechanism 30 is rotated 180° in a direction of arrow in FIG. 3 about the shaft 31 by a driving mechanism (not shown), so that the bottle 20 held is put in an inverted state such that the mouth portion 21 thereof is directed downwardly.

Also, a steam jetting nozzle 42 of the above heating and sterilizing mechanism 40 is inserted upwardly into the mouth portion 21 of the inverted bottle 20 relative to the bottle 20 from the underside of the bottle according to operation for reversing the bottle 20 in the above manner. The diameter of the nozzle 42 is formed so as to be smaller than the inner diameter of the mouth portion 21 of the above bottle 20, and a clearance is formed between an outer periphery of the nozzle 42 which has been inserted and an inner periphery of the mouth portion 21. The depth of insertion of this nozzle 42 is only a portion corresponding to the mouth portion 21 of the bottle 20 in this embodiment.

The steam jetting nozzle 42 has an opening portion at its distal portion, and it jets steam upwardly towards a bottom portion of the bottle 20. Also, in this embodiment, a plurality of side nozzle holes 43 are also formed radially on a side face of the nozzle 42. Then, steam is supplied from a steam supplying mechanism 41 to this nozzle 42, and the steam is jetted from the nozzle 42 into the bottle 20 towards the bottom portion thereof and steam is jetted directly from the above side nozzle holes 43 towards an inner peripheral face of the mouth portion 21.

Figure 7:
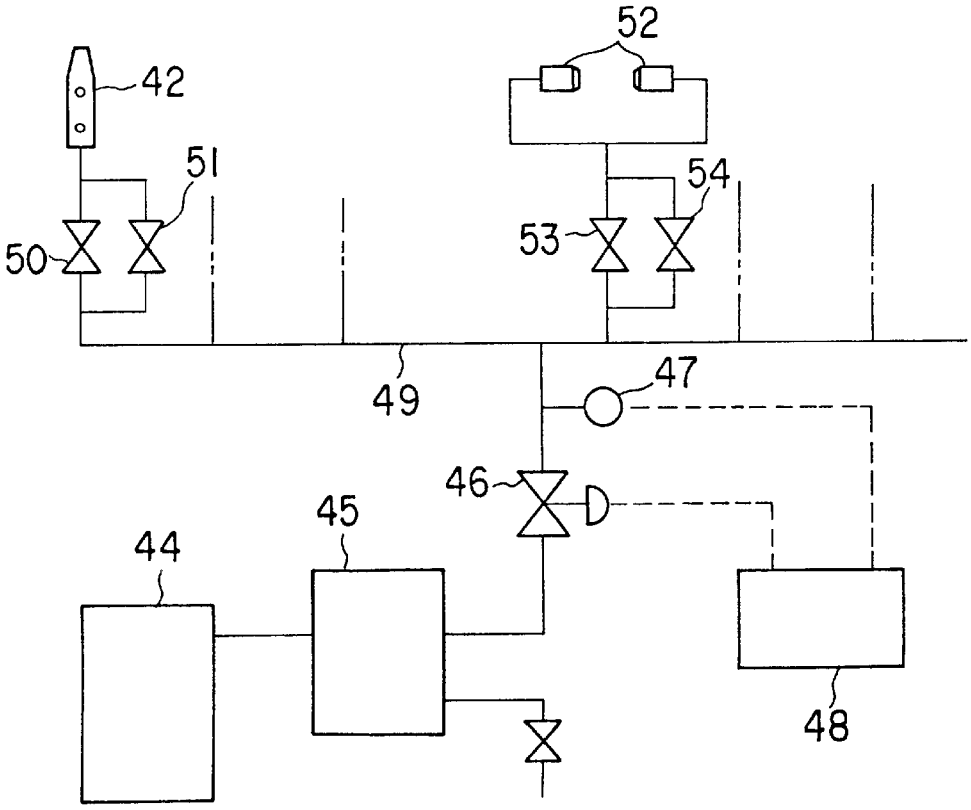
FIG. 7 is a schematic view showing a structure of a steam supplying mechanism of the apparatus shown in FIG. 1.

Also, the steam supplying mechanism 41 for supplying steam to the above steam jetting nozzle 42 is structured, for example, as shown in FIG. 7. That is, reference numeral 44 denotes a boiler which is a steam generating source, and steam which has been supplied from the boiler 44 is supplied to a purifying mechanism 45. The purifying mechanism 45 has a function for removing the boiler compounds mixed in steam supplied from the boiler 44, impurities in pipes and the like, and steam is purified by the purifying mechanism 45, so that pure steam which does not contain impurities is generated.

Then, the pure steam is supplied to the above-mentioned steam jetting nozzle 42 through a pressure regulating valve 46 and a pipe 49. Incidentally, the pressure of this pure steam is detected by a pressure detector 47, and a control circuit 48 send a signal to the above pressure regulating valve 46 on the basis of this pressure signal to maintain the pressure of the pure steam in a constant state. Incidentally, the pressure regulation of the pure steam may be performed by a mechanical pressure regulating valve.

Also, opening/closing valves 50 are respectively provided in the above respective steam jetting nozzles 42, and they are opened/closed according to a sterilizing treatment method described later to jet steam into the bottles 20. Also, bypass valves 51 are provided so as to bypass the opening/closing valves 50, and these bypass valves 50 are always opened at a predetermined opening degree. Therefore, even when the above opening and closing valves 50 are closed, small amounts of steam are always supplied to the nozzles so that contamination in the interiors of the nozzles 42 are prevented.

Figure 6:
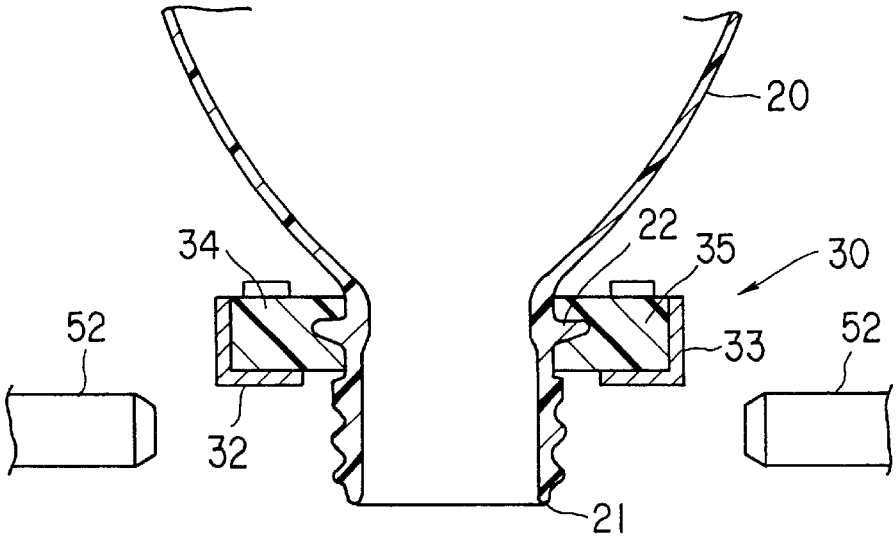
FIG. 6 is a longitudinal sectional view of a mouth portion outer face nozzle portion of the mouth portion of the bottle.

Also, a plurality of, for example two, mouth portion outer face nozzles 52 are provided towards the outer peripheral face of the mouth portion 21 of the bottle 20 at positions where the above heating and sterilizing treatment is performed on the interior of the bottle or positions behind the position of the treatment, as shown in FIG. 6.

These mouth portion outer face nozzles 52 are respectively connected to the pipe 49 of the above steam supplying mechanism 41 through opening/closing valves 53 and bypass valves 54 like the above steam jetting nozzles 42. Then, steam are jetted towards the outer peripheral faces of the mouth portions 21 from the mouth portion outer face nozzles 52, so that heating and sterilizing treatment is performed on the outer peripheral portions of these mouth portions.

Also, as mentioned above, a cooling mechanism 60 for spraying cooling medium, for example, cooling water, on to an outer face of the bottle 20 held in an inverted state is provided at a periphery of the above rotating table 2. The cooling mechanism 60 is constituted by spaying nozzles 61 provided above the bottle 20 and a cooling water supplying mechanism 62 for supplying cooling water to these spraying nozzles 61. The cooling water supplying mechanism 62 supplies city water or cooling water which is maintained at a predetermined purification degree.

Figure 8:
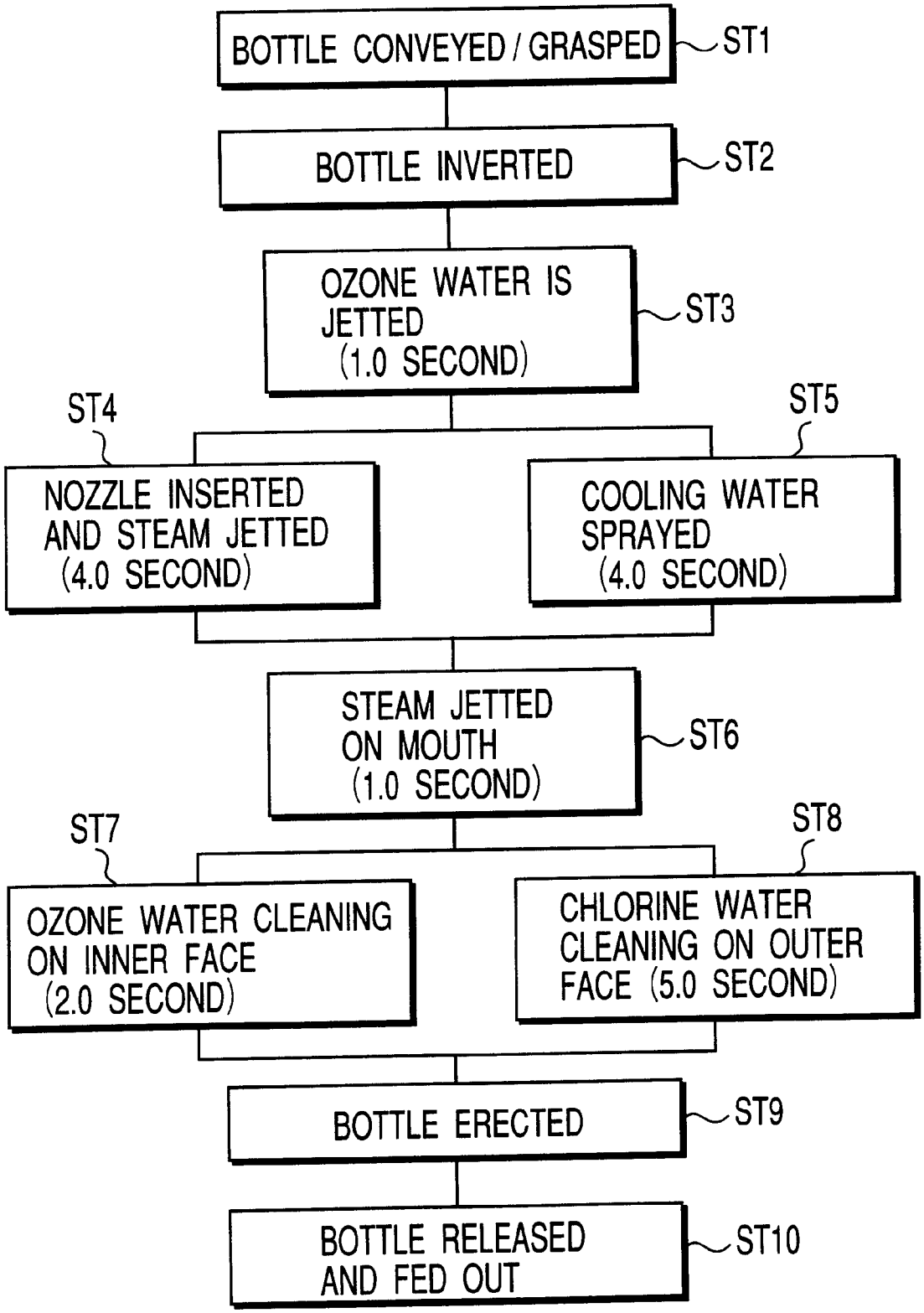
FIG. 8 is a flow diagram of a method for performing heating and sterilizing treatment of the first embodiment of the present invention.

Next, a sterilizing treatment method of the embodiment of the present invention performed by such an apparatus will be explained. FIG. 8 shows a flowchart of this sterilizing treatment method.

First, in Step ST1, the bottle 20 is conveyed in and the bottle 20 is grasped at its mouth portion 21 by the grasping mechanism 6, as mentioned above. Next, in Step ST2, the bottle 20 is inverted as shown in FIG. 3.

Next, In Step ST3, ozone water is jetted on an inner face of the bottle 20 for about 1.0 second by an ozone water cleaning mechanism (not shown) provided in the above sterilizing treatment apparatus, so that the inner face of the bottle 20 is cleaned preliminarily. Incidentally, in this embodiment, pure water containing ozone by about 1 ppm is used as the above ozone water.

Figure 9:
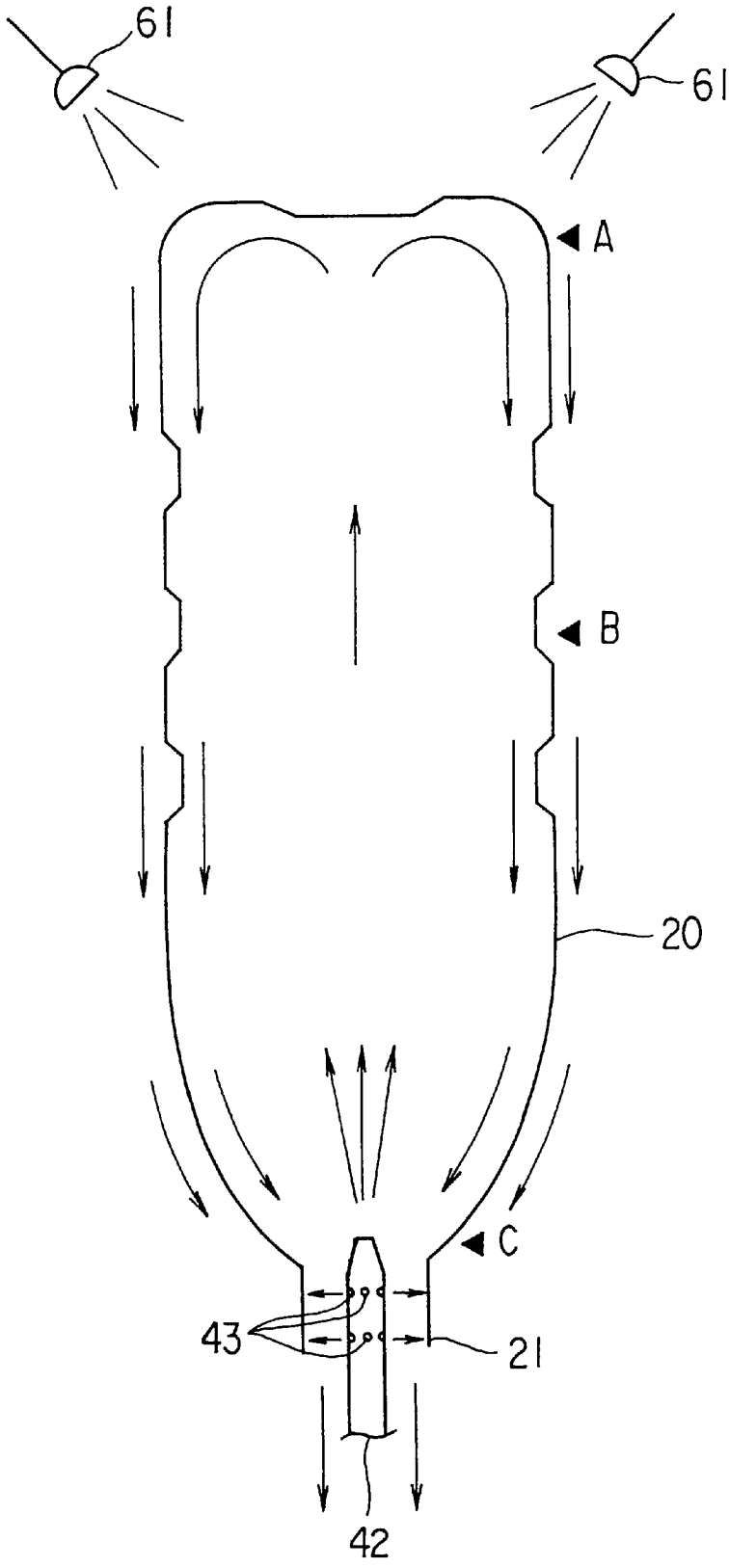
FIG. 9 is a schematic diagram for explaining operation of heating and sterilizing treatment step of a bottle performed by steam jetting.

Next, in Step ST4, the above-mentioned steam jetting nozzle 42 is inserted into the mouth portion 21 of the bottle 2 of the inverted state. Pure steam which has been supplied from the above-mentioned supplying mechanism 41 is jetted from the steam jetting nozzle 42. As shown in FIG. 9, the steam is jetted upwardly towards an inner face of the bottom portion of the bottle 20 put in the inverted state, it is reflected radially due to striking on the inner face of the bottom portion to flow downwardly along the inner face of the side wall portion in a circulating manner, and excess steam is exhausted from the clearance between the inner peripheral face of the above-mentioned mouth portion 21 and the outer peripheral face of the nozzle 42. Also, steam is jetted directly towards the inner peripheral face of the mouth portion 21 from the side nozzle holes 43 of the nozzle 42. Incidentally, in the case of this embodiment, the temperature of the steam is preferably 95° C. or more and the jetting continues for about 4.0 seconds.

Also, in Step ST5, cooling water is sprayed from the spray nozzle 61 to the outer face of the bottle 20 simultaneously with the above Step ST4. Accordingly, the wall face of the bottle 20 is cooled from the outside thereof by spraying the cooling water, so that the temperature rising of the wall face is suppressed and thermal deformation of the bottle 20 is prevented. Incidentally, the spray of cooling water is performed continuously at least during the above jetting of the steam.

Accordingly, since the inner face of the wall face of the bottle 20 is heated and sterilized by steam jetted and the outer face of the wall face is cooled by cooling water, the temperature rising of the wall face of the bottle is suppressed to be low. Thereby, even when a bottle to be sterilized is a bottle with a low heat resistance, heating and sterilizing treatment can be performed efficiently and securely by jetting steam with a high temperature, and the bottle is prevented from thermally deforming.

The temperature of a portion of the bottle near the inner face of the bottle wall face is instantaneously elevated to a high temperature by contacting with such high temperature steam. However, since steam has a heat capacity remarkably smaller than that of hot water, the heat amount transmitted from the steam to the bottle wall face is small. Accordingly, the temperature rising of the bottle wall face is suppressed to be low, so that steam having higher temperature can be used. Incidentally, since bacteria existing on the inner face of the bottle wall face and the like are heated instantaneously to a high temperature by contacting with the steam, effect of sterilizing treatment is not injured and the sterilizing treatment can be performed efficiently and securely.

Also, since the steam is not boiled in pipes or valve devices unlike hot water, the temperature of the steam can be elevated within an allowable range of other conditions, so that the effect of heating and sterilizing treatment becomes large and effective. Also, even if pipes or the like are broken, there is no possibility that steam blown out reaches a far place, and even if the steam contacts with a human body, there is no possibility that he/she is burnt immediately. Thus, the present invention is made safer.

Also, in order to generate steam, the heat amount more than a case of hot water generation by an amount corresponding to heat of vaporization is required. However, since the density of steam is remarkably smaller than that of hot water, the amount of steam used for heating and sterilizing is small so that the required heat amount becomes small. Accordingly, cost for energy required for the steam generation is reduced.

Also, since steam is gas, its fluid property and diffusion property are high and the steam is not affected by gravity. Therefore, steam jetted from the steam jetting nozzle towards the bottle is circulated in the entire of the bottle to be exhausted from the clearance of the mouth portion. Accordingly, even when the shape of the bottle is complicated or complicated projection/recess or the like is formed on a wall face of the bottle, the steam contacts with the inner face of the wall face of the bottle all over the inner face so that secure heating and sterilizing treatment can be achieved.

Also, in this embodiment, the steam jetting nozzle 42 is inserted from the underside of the mouth portion 21 of the bottle 20 which has been put in an inverted state where the mouth portion is directed downwardly so that it jets steam upwardly towards the bottom portion of the bottle. Thereby, since the steam is circulated downwardly along an inner face of the wall face of the bottle to be exhausted from the mouth portion, water which has been condensed on the inner face of the bottle is caused to flow down due to gravity so that the water can be exhausted from the mouth portion together with the steam and the effect of sterilizing treatment becomes more effective. Also, in a case that after this sterilizing treatment another sterilizing treatment is performed, this condensed water does not obstruct the another sterilizing treatment.

Also, in this embodiment, steam is jetted directly on to the inner face of the mouth portion 21 from the side nozzle holes 43 of the steam jetting nozzle 42, as mentioned above. Since steam which has been circulated in the bottle passes through this mouth portion inner face, the inner face contacts with the steam whose temperature has been lowered, so that the effect of the heating and sterilizing treatment tends to lower. However, the heating and sterilizing treatment can be performed on the inner face of the mouth portion more securely by jetting steam directly on the mouth portion inner face.

As mentioned above, after the heating and sterilizing treatment on the inner face of this bottle 20 has been completed, in Step ST6, steam is jetted directly on an outer peripheral face of the mouth portion 21 from the above-mentioned mouth portion outer face nozzles 52 to perform heating and sterilizing treatment on the outer peripheral face of the mouth portion. Accordingly, after the heating and sterilizing treatment of the above-mentioned bottle inside, a possibility that secondary contamination occurs from the outer peripheral face of this mouth portion can securely be removed. Incidentally, in this embodiment, steam jetting on to the outer face of the mouth portion 21 is performed for about 1.0 second.

Next, in Step ST7, ozone water is jetted to the bottle inner face to perform finishing cleaning on this inner face. In this embodiment, pure water containing ozone water by about 1 ppm is used as this ozone water. The ozone water which has been used in this Step is recovered and reproduced to be reused for preliminary cleaning of the bottle inner face in the above-mentioned Step ST3. Incidentally, in this embodiment, the finishing cleaning is performed for about 2.0 seconds.

Also, in Step ST8, disinfecting water such as chlorine water or the like is sprayed on the outer face of the bottle 20 to perform cleaning and sterilizing treatment on the outer face of the bottle. Incidentally, this step of the outer face cleaning is performed for about 5.0 seconds in a case of this embodiment.

In the above manner, after the cleaning and sterilizing treatments on the inner face and the outer face of this PET bottle 20 are completed, in Step ST9, the above grasping mechanism 6 is inverted so that the bottle which has been grasped is erected. Thereafter, in Step ST10, the grasp of the bottle is released and the bottle is fed out to the feeding-in conveyor 8 by the above-mentioned feeding-out rotor 7 to be sent to the next filling step or the like.

Figure 10:
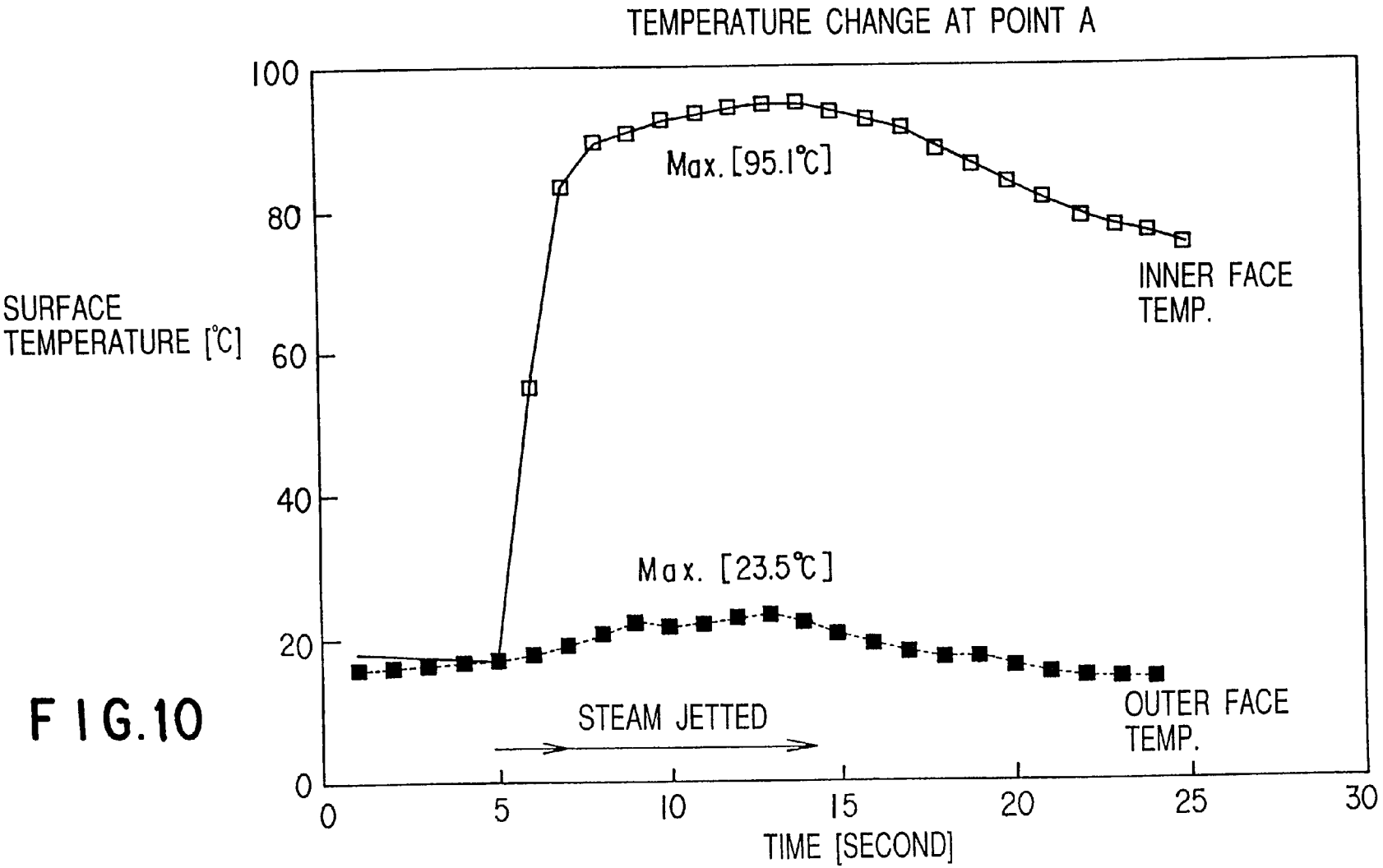
FIG. 10 is a graph showing temperature change on inner and outer faces of a bottle on a point A in FIG. 9.
Figure 11:
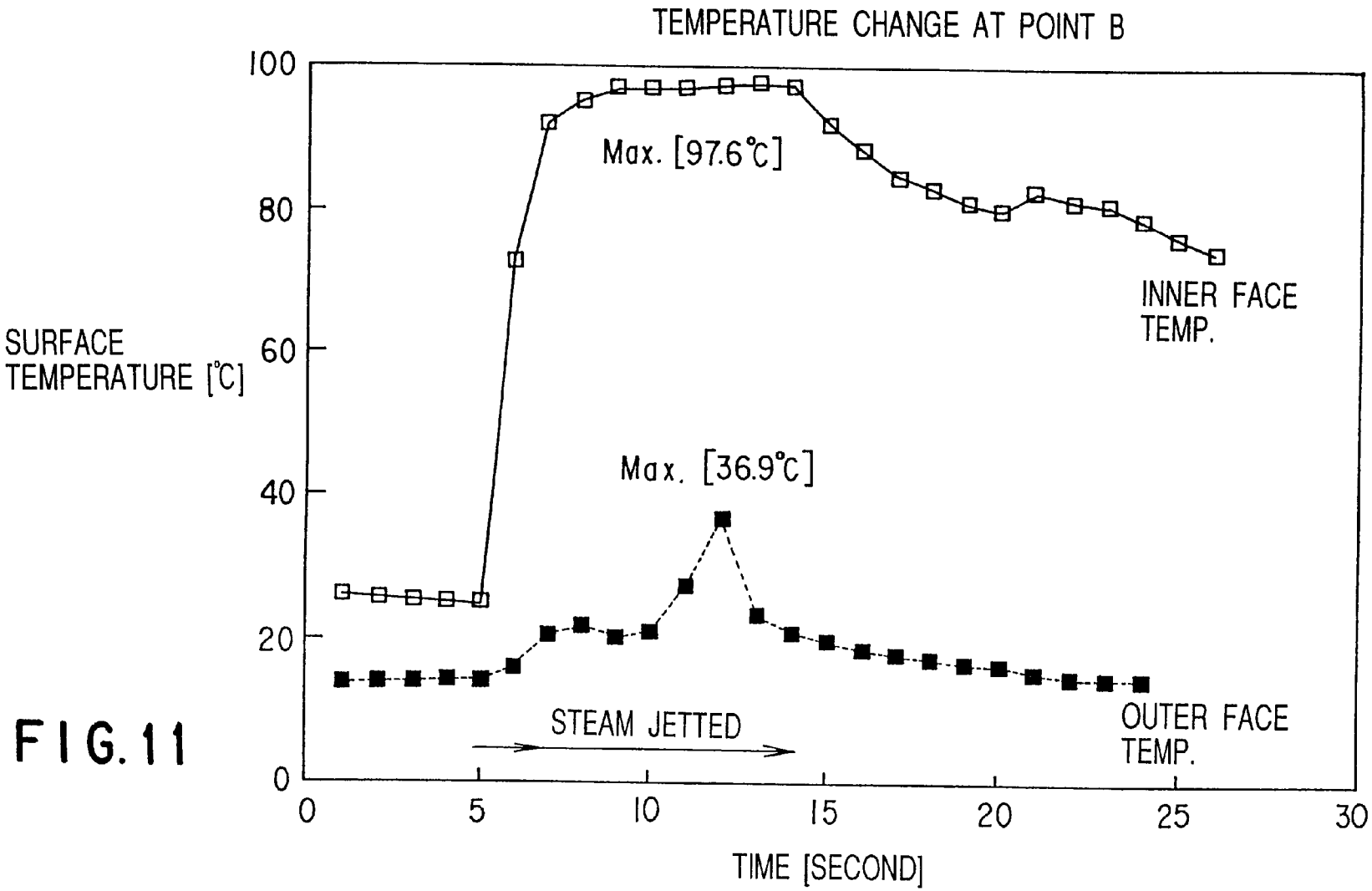
FIG. 11 is a graph showing temperature change on inner and outer faces of a bottle on a point B in FIG. 9.
Figure 12:
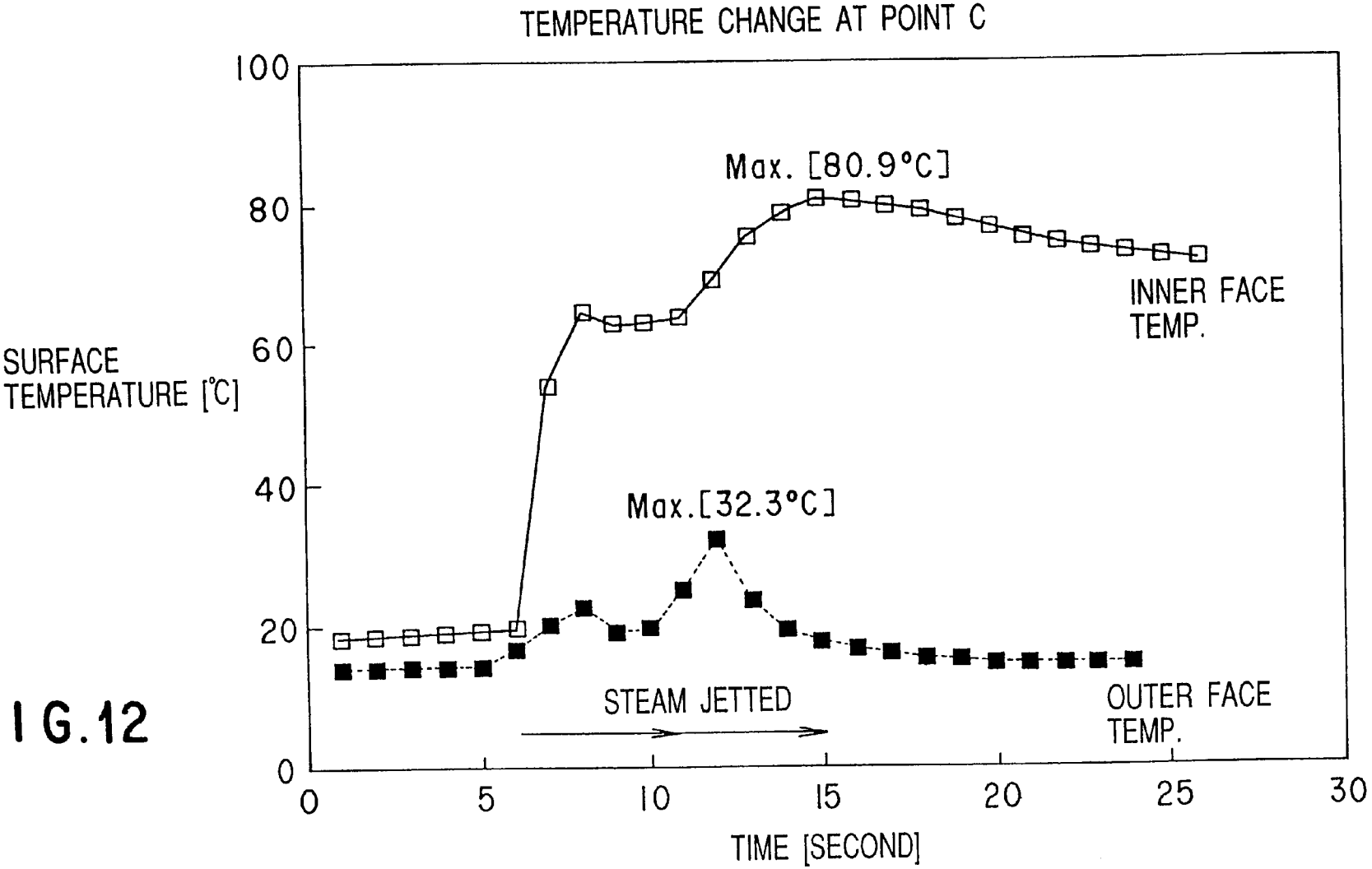
FIG. 12 is a graph showing temperature change on inner and outer faces of a bottle on a point C in FIG. 9.

Next, the results of the. effect of the above heating and sterilizing treatment performed by jetting steam will be explained. FIG. 10 to FIG. 12 are graphs showing temperature changes of the inner face and the outer face of the bottle 20 at the time of heating and sterilizing treatment performed by jetting steam. Incidentally, in this test, a steam jetting nozzle on which the side nozzle holes 43 which have been explained in the above-mentioned embodiment have not been formed was used in order to clarify the relationship between the circulation of steam in the bottle and the temperature of the bottle wall face. Also, the bottle used for test is a rectangle-shaped PET bottle having anti-heat resistance and having the volume of 2000 ml.

FIG. 10 shows temperature change at a point A shown in FIG. 9, FIG. 11 shows temperature change at a point B shown in FIG. 9, and FIG. 12 shows temperature change at a point C shown in FIG. 9. These temperatures were measured by sheet-like thermocouple type thermometers attached to an inner face and an outer face of the bottle 20. Also, in these cases, steam whose temperature is in a range of 95 to 100° C. was jetted for about 10 seconds, and the temperature of cooling water was in a range of 15 to 16° C.

As apparent from FIG. 10 and FIG. 11, at the point A on the bottom portion side face of the bottle 20 and the point B on the central portion side face thereof, the temperatures of the bottle inner face are increased up to temperatures near the temperature of jetted steam in a much short time from jetting start of steam, and thereafter the temperature of the inner surface is maintained at about 90° C. for 10 seconds of the steam jetting. Accordingly, a sufficient heating and sterilizing treatment can be performed.

Also, at the point C on the mouth portion, as shown in FIG. 12, the inner surface temperature is increased up to about 65° C. immediately after the jetting start, and thereafter this temperature is maintained for 5 seconds or so. Then, the temperature is increased up to about 80° C. The reason is estimated because steam which has been cooled by contacting with the inner face of the bottle in a low temperature state just after the jetting start is exhausted through the mouth portion and thereafter when the temperature of the bottle inner surface is increased, steam with lesser temperature lowering passes through the mouth portion.

Accordingly, in the same manner as the above-mentioned embodiment, when a structure is employed where side nozzle holes are formed on this steam jetting nozzle so that steam is jetted directly on the inner face of this mouth portion, the temperature of the inner surface of this mouth portion is increased up to a temperature generally equal to the steam temperature immediately after jetting start like the temperatures at the above points A and B so that the heating and sterilizing treatment can be performed more securely.

Incidentally, the characteristic of the temperature rising on the inner surface of the above mouth portion is, of course, affected by various conditions such as the bottle volume, the jetting amount of steam and the like. For example, when the jetting amount of steam becomes larger relative to the volume of the bottle, such a characteristic that the temperature rising on the inner surface of the mouth portion reaches higher temperature in shorter time shows.

Also, at the respective points A, B and c, the temperatures on the outer surface of the bottle are respectively maintained in a range of 20 to 30° C. This temperature is a glass-transition temperature or less of resin material for an anti-heat resistant PET bottle so that thermal deformation of this bottle can be prevented securely. Incidentally, after the test of the above heating and sterilizing treatment was finished, thermal deformations at respective portions of this PET bottle were measured. However, slight thermal deformations which do not affect the use of this PET bottle were only recognized.

Incidentally, at the points B, C shown in FIG. 11 and FIG. 12, the temperatures on the outer surface of the bottle were temporarily increased to 30° C. or more after about 5 seconds from the steam jetting start. This is because steam is condensed on the bottle inner face and the condensed hot water flows down along the bottle inner face. As mentioned above, since the heat amount transferred through contacting with hot water is large, even the outer surface of the bottle wall face is heated to a high temperature. Accordingly, in view of preventing the thermal deformation of the bottle, it is preferable to set jetting time in a range where the hot water which has been condensed on the bottle inner face in the above manner does not flow down, namely to set the jetting time to 5 seconds or less.

Figure 13:
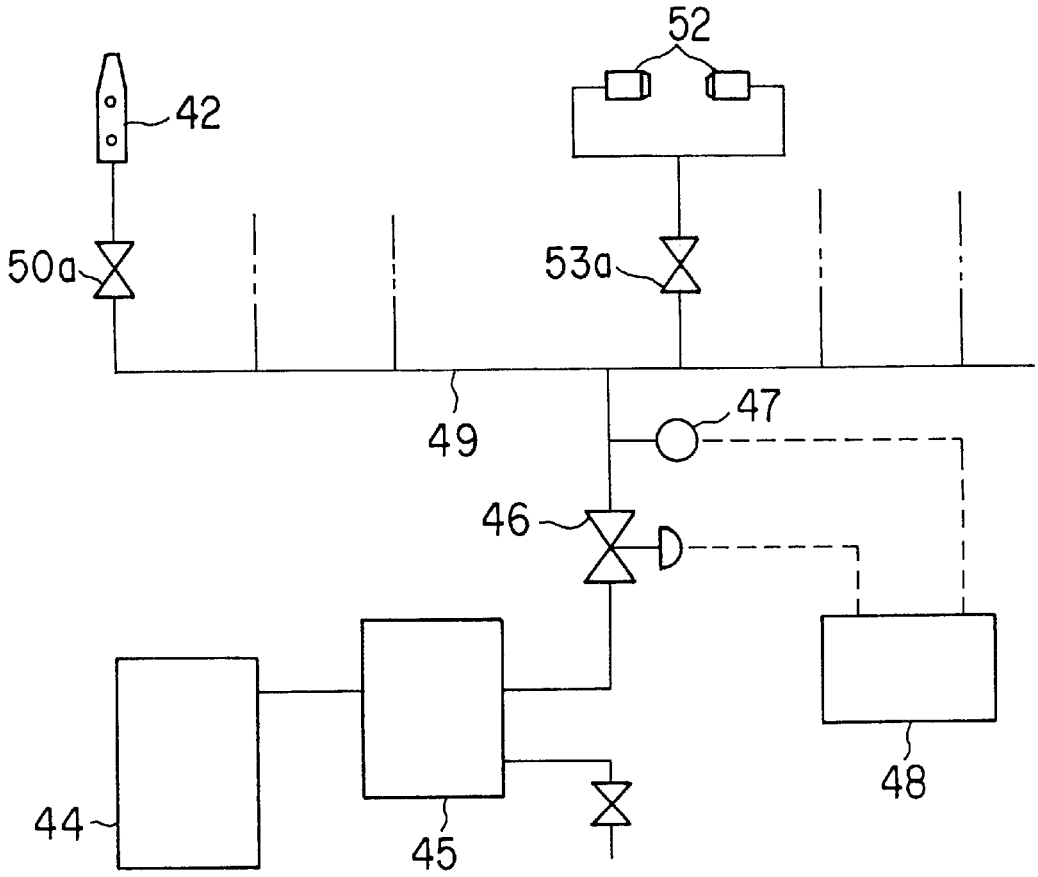
FIG. 13 is a schematic diagram showing a structure of a steam supplying mechanism in an apparatus used by a method of a second embodiment.
Figure 14:
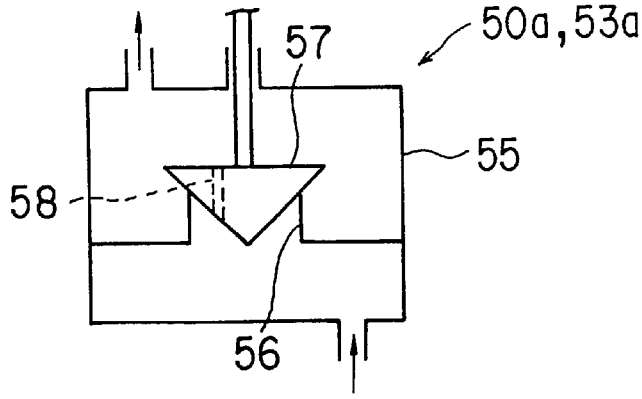
FIG. 14 is a schematic diagram of a structure of an opening/closing valve mechanism of the apparatus shown in FIG. 13.

Incidentally, the present invention is not limited to the above first embodiment. For example, FIG. 13 and FIG. 14 show an apparatus used in a second embodiment of the present invention.

In this apparatus, the above-mentioned bypass valves 51, 54 are omitted and opening/closing valves 50*a*, 54*a* having a bypass passage inside are used. As shown in FIG. 14, the opening/closing valve is structured such that a bypass hole 58 is formed in a valve body 57 for opening/closing a valve opening 56 in a valve box 55. In this opening/closing valve, even when the valve body 57 is put in a closed state, steam is supplied to the nozzle through the bypass hole 58 little by little, and supplying steam to this nozzle is not stopped so that contamination within the nozzle can securely be prevented.

Figure 15:
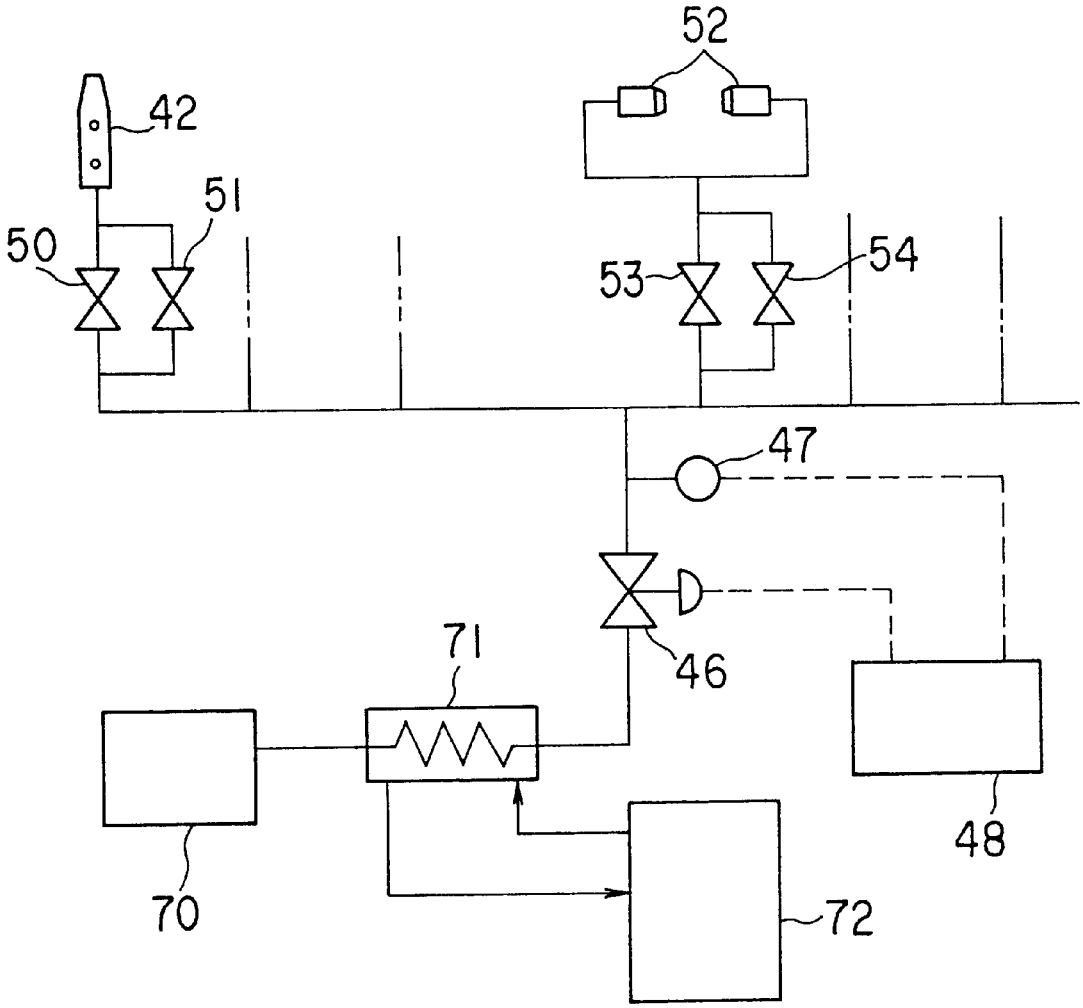
FIG. 15 is a schematic diagram of a structure of a steam supplying mechanism of an apparatus used for a method of a third embodiment.

Also, FIG. 15 shows an apparatus used in a third embodiment. The apparatus is structured such that pure water supplied from a pure water supplying source 70 is heat-exchanged with steam supplied from a boiler 72 in a heat-exchanger 71 to produce pure steam.

Figure 16:
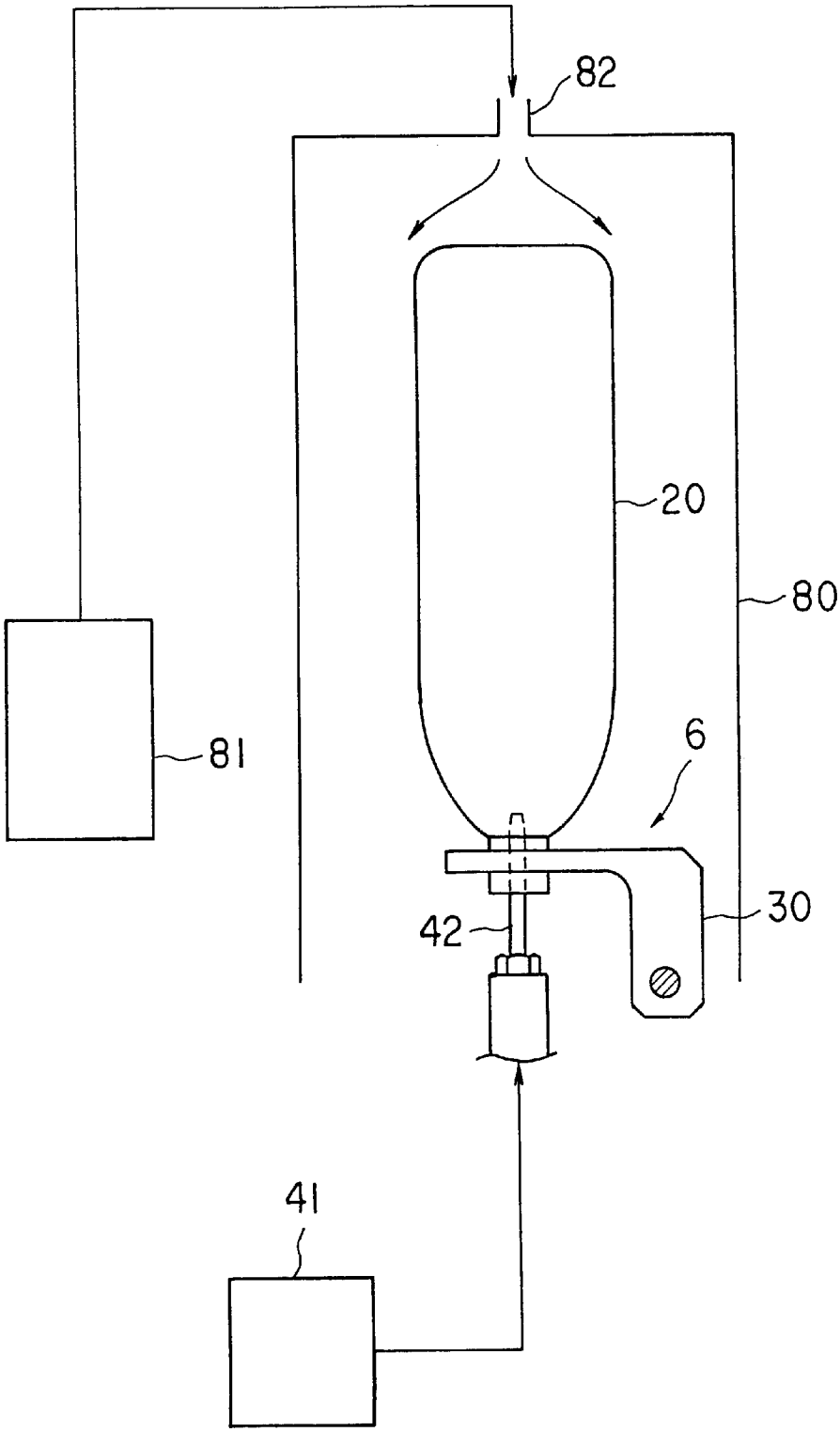
FIG. 16 is a schematic side diagram of a grasping mechanism portion of an apparatus used for a method of a fourth embodiment.

Also, FIG. 16 shows an apparatus used in a fourth embodiment. In this apparatus, cooling wind is used as the above cooling medium instead of the cooling water. That is, the outside of the bottle 20 which has been maintained in an inverted state by the grasping mechanism 6 is surrounded by a hood 80 and cooling wind supplied from a cooling wind supplying mechanism 81 is fed in the hood through a blowing nozzle 82 formed at an upper end portion of the hood 80, so that this cooling wind is caused to flow along the outer face of the bottle, thereby cooling the outer face of the bottle. In the apparatus, since cooling water is not used for cooling the outer face of the bottle, the structure of the apparatus is made simple and there is no possibility of re-contamination inside the bottle due to cooling water.

Incidentally, the apparatus used in the above-mentioned embodiment is the same as the apparatus used in the above-mentioned first embodiment except for the above points. Accordingly, in FIG. 13 to FIG. 16, portions corresponding to the first embodiment are attached with same reference numerals and explanation thereof will be omitted.

Incidentally, the present invention is not limited to the above embodiments. In this invention, of course, the various features and conditions which have been disclosed in the above embodiments may be properly selected and combined so as to correspond to kind of a bottle to be subjected to sterilizing treatment, a level of sterilizing treatment, and the other specification.

According to the method of the present invention as mentioned above, an inner face of a wall face of a container is heated and sterilized by jetted steam, and an outer face of this wall face is cooled by cooling medium. In addition, since steam has a smaller heat capacity than that of hot water and the heat amount transferred to a wall face of a bottle is small, the temperature rising on the wall face of this container is suppressed to be low. Accordingly, even when the container is a container with a low heat resistance, heating and sterilizing treatment can be performed effectively and securely by jetting steam with a high temperature.

Also, since there is no possibility that steam is boiled in pipes or valve devices like hot water, the temperature of the steam can be increased in an allowable range of other conditions so that the effect of the heating and sterilizing treatment is made large and effective. Also, even if pipes or the like are broken, there is no possibility that steam blown out reaches a far place, and even if the steam contacts with a human body, there is no possibility that he/she is burnt immediately. Thus, the present invention is made safer.

Also, in order to generate steam, the heat amount more than the case of generating hot water by the amount corresponding to heat of vaporization is required, but since the density of steam is remarkably smaller than that of hot water, the amount of steam used for heating and sterilizing is small so that the required heat amount is make small. Accordingly, cost for energy required for generating the steam is reduced.

Furthermore, since steam is gas, its fluid property and diffusing property are high and the steam is not affected by gravity. Therefore, the steam jetted from the steam jetting nozzle into the container is circulated in the entire of the container to be exhausted from the clearance of the mouth portion. Therefore, even when the shape of the container is complicated or even when complicated recesses/projections or the like are formed on a wall face of the container, the steam contacts with the wall face of the container without exception, so that such an effect that secure heating and sterilizing treatment can be achieved is large.

Also, according to the apparatus of the present invention, in an apparatus for performing heating and sterilizing treatment by jetting steam inside a container while cooling an outer face of the container by cooling medium, since steam is jetted directly to an inner face of a mouth portion of the container from the side nozzle holes, such an effect that the mouth portion whose temperature rising tends to be insufficient is heated securely, the heating and sterilizing treatment can be performed more effectively and more securely, the structure of the apparatus is simple, its reliability is also high, or the like is large.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for performing a sterilizing treatment on a plastic bottle having a necked mouth portion comprising the steps of:

inserting a steam jetting nozzle into the bottle through the mouth portion of the bottle to be subjected to the sterilizing treatment with a clearance formed between the nozzle and an inner face of the mouth portion, the bottle being so positioned that the mouth portion of bottle which is placed in an inverted state is directed downward;

upwardly jetting steam into the bottle from the steam jetting nozzle and circulating the jetted steam in the bottle to exhaust the steam from the clearance between the steam jetting nozzle and the inner face of the mouth portion, and jetting steam toward the inner face of the mouth portion to heat the mouth portion; and supplying cooling medium to an outer face of the bottle simultaneously with the step of jetting steam to cool a wall of the bottle.

2. A method for performing a sterilizing treatment on a plastic bottle according to claim 1, wherein the temperature of the steam jetted from the steam jetting nozzle is 95° C. or more.

3. A method for performing a sterilizing treatment on a plastic bottle according to claim 1, further comprising a step of jetting steam to an outer face of the mouth portion of the bottle after the step of jetting steam.

4. A method for performing a sterilizing treatment on a plastic bottle according to claim 1, wherein the cooling medium supplied to the outer face of the bottle is cooling water.

5. A method for performing a sterilizing treatment on a plastic bottle according to claim 1, wherein the cooling medium supplied to the outer face of the bottle is cooling wind.

6. A method for performing a sterilizing treatment on a plastic bottle according to claim 1, wherein the steam jetted from the steam jetting nozzle into the bottle is pure water steam where impurities are removed from steam supplied from a boiler.

7. A method for performing a sterilizing treatment on a plastic bottle according to claim 1, wherein the steam jetted into the bottle from the steam jetting nozzle is pure water steam generated by heating pure water in a heat-exchanger.

8. An apparatus for performing a heating and sterilizing treatment on an inner face of a plastic bottle having a necked mouth portion, comprising a holding mechanism for holding a bottle to be subjected to sterilizing treatment, so as to invert the bottle in an inverted state where the bottle is inverted such that the mouth portion of the bottle is directed downwardly;

a steam jetting nozzle inserted into a mouth portion of the bottle, the nozzle having at least one first opening directed toward an inner face of a bottom of the bottle and at least one second opening directed to an inner peripheral face of the mouth portion, and the diameter of the steam jetting nozzle being smaller than the inner diameter of the mouth portion of the bottle, so that a clearance is formed between the inner peripheral face of the mouth portion and an outer peripheral face of the steam jetting nozzle; and a steam supplying mechanism for supplying steam to the steam jetting nozzle, thereby jetting the steam from the first and second openings into the bottle, wherein the jetted stream from the first opening is circulated in the bottle and exhausted from the clearance between the steam jetting nozzle and the jetted stream from the second opening is directly in contact with the inner peripheral face of the mouth portion.

9. An apparatus for performing a heating and sterilizing treatment on an inner face of a plastic bottle according to claim 8, wherein the holding mechanism is provided with a grasping mechanism for grasping the mouth portion of the bottle, and the grasping mechanism is rotated 180° about a pivot axis, so that the bottle so held is placed in said inverted state.

10. An apparatus for performing a heating and sterilizing treatment on an inner face of a plastic bottle according to claim 8, comprising a mouth portion outer face nozzle for jetting steam towards an outer face of the mouth portion of the bottle.

11. An apparatus for performing a heating and sterilizing treatment on an inner face of a plastic bottle according to claim 8, wherein an opening/closing valve for shutting off steam supplied to the steam jetting nozzle is provided in the steam supplying mechanism, and a bypass valve for supplying a predetermined amount of steam to the steam jetting mechanism even when the opening/closing valve is in a closed state is provided so as to bypass the opening/closing valve in parallel therewith.

12. An apparatus for performing a heating and sterilizing treatment on an inner face of a plastic bottle according to claim 8, wherein an opening/closing valve for shutting off steam supplied to the steam jetting nozzle is provided in the steam supplying mechanism and a bypass passage for supplying steam to the steam jetting nozzle even when the opening/closing valve is in a closed state is formed inside the opening/closing valve.

13. A method for performing a sterilizing treatment on a plastic bottle comprising the steps of:

positioning the bottle so that the mouth portion of the bottle which is placed in an inverted state is directed downward;

upwardly raising a jetting nozzle so that the nozzle is inserted into the bottle through the mouth portion of the bottle, a clearance being formed between the nozzle and an inner face of the mouth portion, supplying steam into the nozzle to upwardly jet the steam into the bottle from the steam jetting nozzle and circulating the jetted steam in the bottle to exhaust the steam from the clearance between the steam jetting nozzle and the inner face of the mouth portion, thereby performing sterilizing treatment of the bottle;

supplying cooling medium to an outer face of the bottle simultaneously with the step of jetting steam to cool a wall of the bottle;

stopping the supply of cooling medium;

controlling the steam jetted from the nozzle to prevent the nozzle from being cooled; and downwardly moving the nozzle to be removed from the bottle, wherein said controlling step is maintained until the next sterilizing treatment starts.

14. The method according to claim 13, said step of supplying steam also jets the steam in a lateral direction to directly contact the inner face of the mouth portion.

15. An apparatus for performing a heating and sterilizing treatment on an inner face of a plastic bottle having a necked mouth portion comprising:

a table having a central axis;

a main body supporting the table to be rotated about its central axis, the table having an horizontal upper face;

a plurality of grasping mechanisms provided at peripheral portions of the table, the grasping mechanism grasping the mouth portion of the bottle conveyed and rotating 180° up and down so that the bottle is placed in an inverted state such that the mouth portion is directed downward;

a plurality of heating and sterilizing mechanisms mounted on the table to correspond the grasping mechanisms, respectively;

a plurality of cooling mechanisms mounted on the table to correspond the grasping mechanisms, respectively, each of cooling mechanisms cooling the bottle grasped by the grasping mechanism, upon rotation of the table;

each of said heating and sterilizing mechanism including a nozzle which is vertically moved between a stabilizing position where the nozzle is inserted in the bottled grasped by the grasping mechanism through the mouth portion with a circular clearance formed between the nozzle and the mouth portion, and a rest position where the nozzle is removed from the bottle, the nozzle having at least one opening; and a steam supplying mechanism for supplying steam to all nozzles in the sterilizing states so that steam is jetted into the bottles from the nozzles, circulated in the bottles, and then exhausted from the clearance between the nozzles and the mouth portions.

16. The apparatus according to claim 15 wherein a plurality of openings are provided in the nozzle to jet stream in upper and lateral directions.

17. The apparatus according to claim 15 wherein said steam supplying mechanism supplies steam to all nozzles in the rest positions in a smaller amount than those in the sterilizing positions.

* * * * *